US005099581A

United States Patent [19]

Svehaug

[11] Patent Number: 5,099,581

[45] Date of Patent: Mar. 31, 1992

[54] PORTABLE LIGHTED DRAFTING TABLE

[76] Inventor: Oswald C. Svehaug, 1010 San Ysidro Blvd., San Ysidro, Calif. 92073

[21] Appl. No.: 699,432

[22] Filed: May 13, 1991

[51] Int. Cl.[5] ..... B43L 5/00

[52] U.S. Cl. ..... 33/430; 33/1 AA

[58] Field of Search ..... 362/97, 98; 33/430, 33/443, 444, 445, 1 AA; 434/85, 88

[56] References Cited

U.S. PATENT DOCUMENTS

| | | | |
|---|---|---|---|
| 416,437 | 12/1989 | Bradley | 33/430 |
| 537,930 | 4/1995 | Nowland | 33/427 |
| 2,257,005 | 9/1941 | Grosse | 362/97 X |

*Primary Examiner*—Harry N. Haroian
*Attorney, Agent, or Firm*—Henri J. A. Charmasson

[57] ABSTRACT

A portable, lighted drafting station comprises a shallow tray the size of a briefcase having a cover made from a sheet of translucent material sliding into slots in the rim of the tray. A T-square and two triangles are held by a set of brackets against the undersurface of the cover. A fluorescent light inside the tray resting over a sheet of reflective material leaves enough storage to accommodate pencils and other drafting implements. A simple, spring-biased bolt locks the cover into the tray by engaging a notch into the stored T-square.

5 Claims, 2 Drawing Sheets

FIG. 1
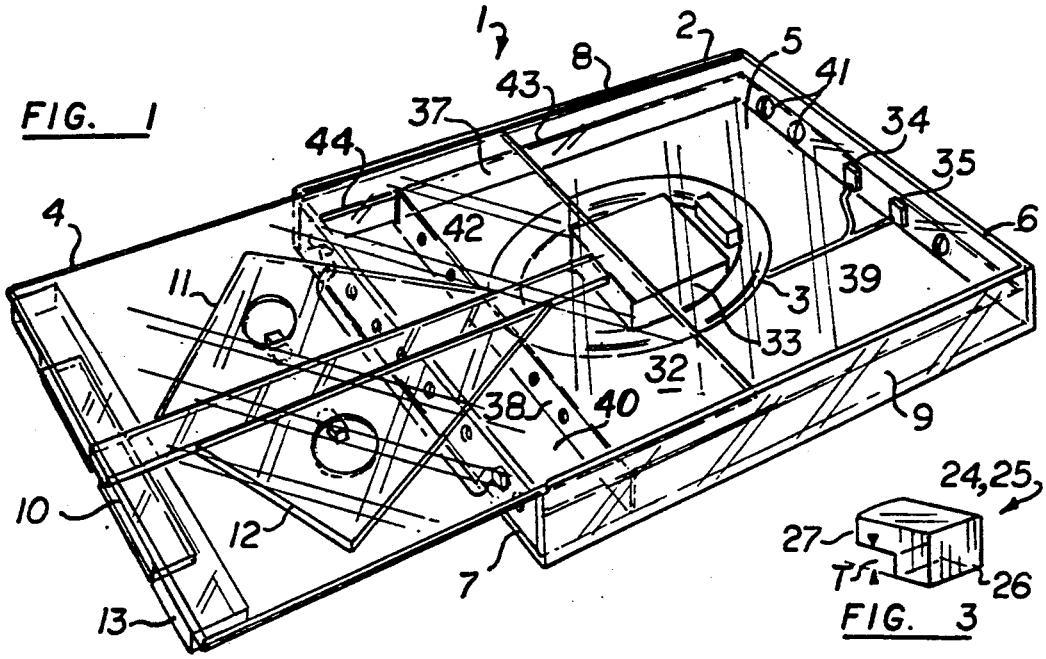
FIG. 3
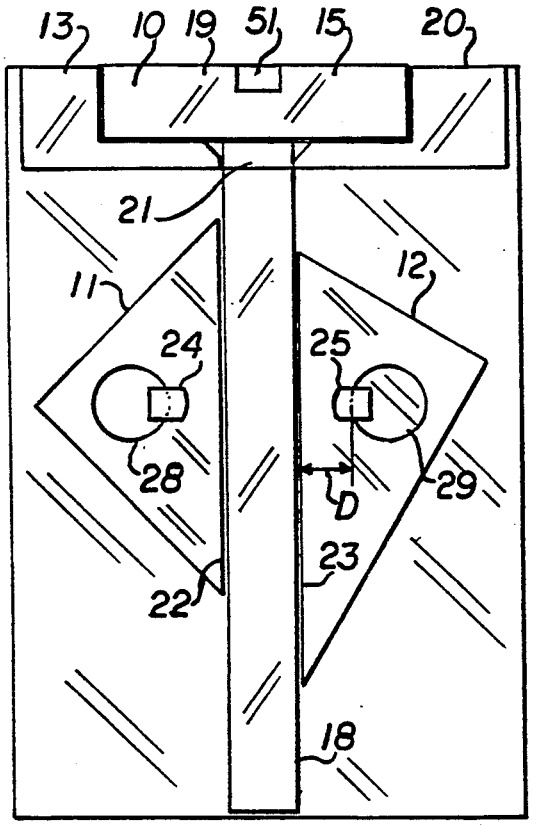
FIG. 2
FIG. 4
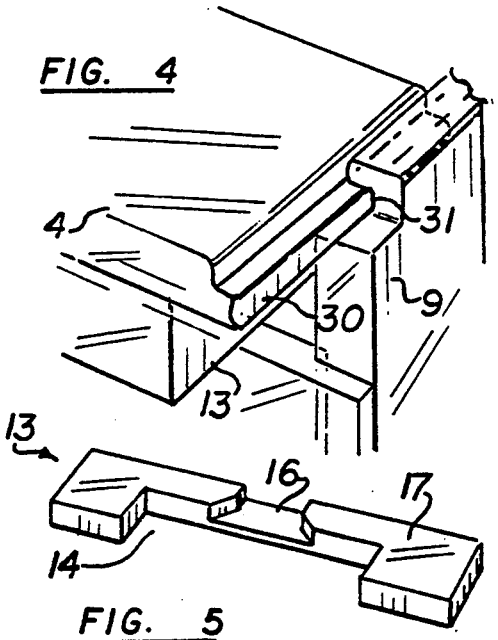
FIG. 5

PORTABLE LIGHTED DRAFTING TABLE

FIELD OF THE INVENTION

This invention relates to drafting tables, and more specifically to lighted drafting tables used for tracing.

BACKGROUND OF THE INVENTION

The lighted drafting table or tracing table of the prior art are heavy, voluminous, and generally cumbersome structures with a great deal of unused inside space due to the great distance required between the light and the upper transparent or translucent work surface in order to provide even illumination of the latter. When they are used on a desktop or on top of a regular drafting table, their great depth raises the level of the work surface to an uncomfortable level for the draftsman.

There is a need for a more compact, lighted drafting table that can be used as a comfortable drafting station when placed on a desktop.

SUMMARY OF THE INVENTION

The principal and secondary objects of this invention are to provide a shallow, light and versatile lighted drafting table which can also provide storage for drafting implements. These and other objects are achieved by means of a lightweight, portable and shallow tray containing a fluorescent light, with a cover made from a slab of translucent material which slides into slots into the rim of the tray. A set of brackets on the undersurface of the cover are used to hold a T-square and set of triangles made of transparent material. The entire structure is made of translucent polycarbonate material. It is the side of a briefcase and has a convenient carrying handle, as well as a back-hanging slot so that the lighted device may be used as a display for transparencies or even as a light fixture.

BRIEF DESCRIPTION OF THE DRAWING

FIG. 1 is a perspective view of a lighted drafting station according to the invention;

FIG. 2 is a bottom plan view of the cover and the drafting implements stored against it;

FIG. 3 is a perspective view of a triangle holding bracket;

FIG. 4 is a detail view of the cover and side wall interface;

FIG. 5 is a perspective view of the T-square holding bracket;

DESCRIPTION OF THE PREFERRED EMBODIMENT OF THE INVENTION

Figure 6:
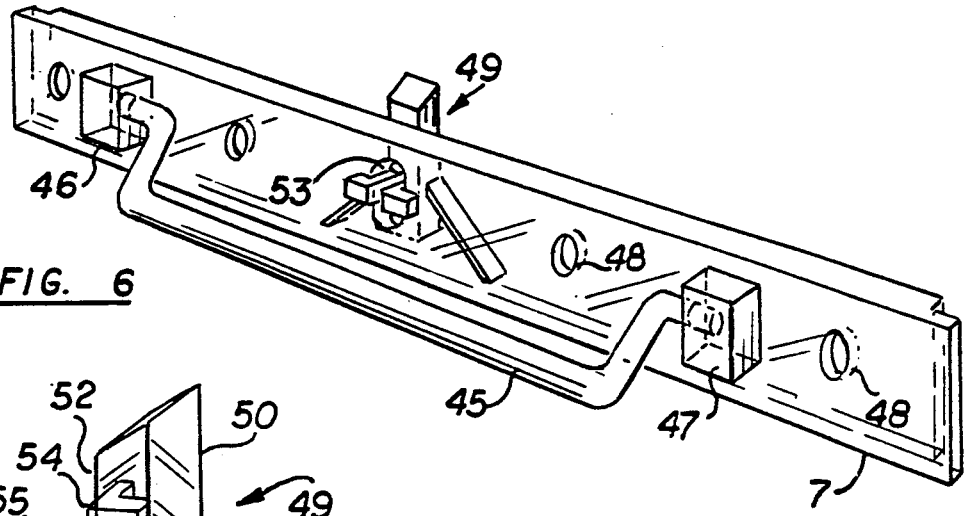
FIG. 6 is a perspective view of the front wall.
Figure 7:
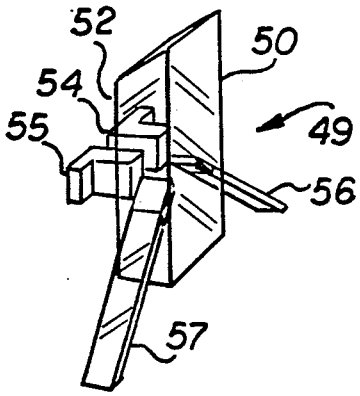
FIG. 7 is a perspective view of the locking bolt.

Referring now to the drawing, there is shown a lighted work station 1 with an illuminated work surface particularly useful for tracing or for viewing transparencies. The work station consists essentially of an enclosure 2 containing a fluorescent circular light 3 and a cover 4 made of a slab of translucent material. The enclosure 2 is a shallow tray having a bottom plate 5 and two pairs of parallel walls 6, 7, 8 and 9. All these structural elements of the enclosure 2 are made of acrylic material. However, while the cover 4 is made of a translucent white hue material, the tray is preferably made of a more opaque material. For sake of clarity in the drawing, the entire enclosure is shown as being made of transparent elements.

Stored against the undersurface of the cover 4 are a T-square 10 and two drafting triangles 11, 12. The T-square and triangles are made from transparent material such as Plexiglass. The T-square is held in place by a bracket 13 which has a rectangular recess 14 dimensioned to receive the cross-member 15 of the T-square. A slot 16 in the upper surface 17 of the bracket which is bonded to the underside of the cover 4 is engaged by the leg 18 of the T-square. When the T-square is fully engaged with the outer edge 19 of the cross-piece 15 aligned with the edge 20 of the cover, the slot 16 in the bracket 13 surrounds and holds a neck- section 21 of the T-square proximate the intersection of the cross-piece 15 and leg 18.

The triangle 11, 12 are also held against the undersurface of the cover with one side 22, 23 abutting opposite edges of the leg 18 of the T-square. Each triangle is engaged into a L-shaped bracket 24, 25. A first leg 26 of each bracket is bonded to the underside of the cover 4 and the other leg 27 projects toward the center of the cover where the T-square is located. The clearance T between the upper leg and the undersurface of the cover 4 corresponds to the thickness of the triangles. The distance D between the first leg 26 and the edge of the T-square corresponds to the distance between the abutting side 22, 23 of the triangle and a void or cutout 28, 29 in the middle of each triangle. It should be understood that the triangles 11, 12 must first be mounted on their respective brackets 24, 25 before the leg 18 of the T-square is inserted between them.

As more clearly shown in FIG. 4, the cover, has on each side a lip or tongue 30 which slides into a slot 31 in the rim of the tray 2, or more specifically the top edges of the lateral walls 8, 9. A circular fluorescent light 3 is mounted against the bottom center 32 of the tray and surrounds the coil starter and ballast 33. Power is received through an AC connector 34 mounted to the backwall 6 of the tray and a switch 35 similarly mounted. A transparent shield 37 having a right-angle flange 38 protects the fluorescent light 3 starter assembly 33 wiring 39 and internal portions of the connector 34 and switch 35 leaving a storage area 40 along the front panel for drafting tools. Ventilation holes 41 and 42 are cut through the backpanel 6 and the flange 38 of the cover respectively. Like the cover 4, the shield 37 has a lateral lips 43 engaging parallel slot 44 in the lateral walls 8, 9. In order to guarantee the maximum illumination of the translucent cover 4, the internal wall surfaces and bottom of the tray are sprayed with a white or metallic paint.

Figure 8:
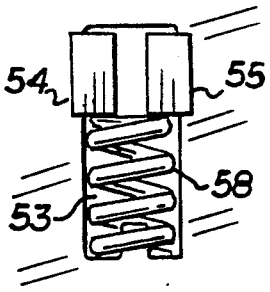
FIG. 8 is a front elevational view of an alternate biasing system for the bolt.
Figure 9:
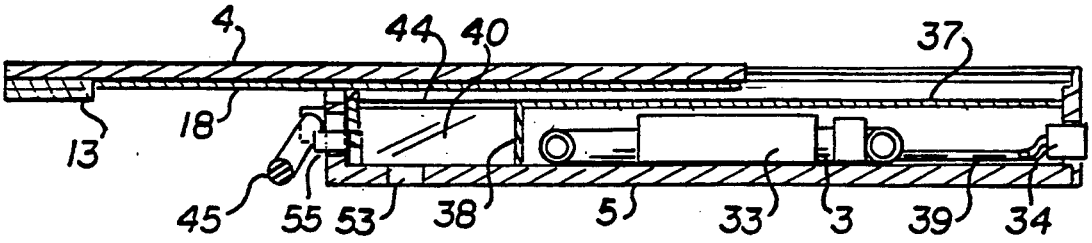
FIG. 9 is a median cross-sectional view of the drafting station.

The front panel 7 has a height slightly smaller than the height of the other walls in order to accommodate the thickness of the T-square holding bracket 13. A carrying handle 45 supported by two mounting blocks 46, 47 bonded to the front surface of the front wall 7 can be used to carry the entire work station like a briefcase. The front wall is pierced with a plurality of aeration holes 48 and includes a lock assembly 49 in its center. The lock assembly 49 consists essentially of a bolt 50 which is shaped and dimensioned to engage a notch 51 in the cross-piece 15 of the T-square. Projecting from the front face 52 of the bolt through a slot 53 in the front wall are two L-shaped prongs 54,55 which are resilient enough to be squeezed one toward the other for insertion through the aperture 53. Each prong has a return nib 60 which projects against the front face of the front wall 7 around the rim of the aperture 53 when released thus locking the bolt assembly into place. The bolt 50 is held biased in its uppermost position where it engages the slot 51 in the T-square by two flexible legs 56, 57 extending obliquely from the side of the blocks into contact with the bottom surface of the tray. The bolt can be moved down by pressing on the two L-shaped prongs 54, 55 to free the cover 4. An alternate biasing of the bolt is illustrated in FIG. 8 where the two prongs 54, 55 are biased upwardly by a coil spring 58 mounted within the aperture 53.

A hanging hole 59 is cut through the middle portion of the bottom plate in the storage recess area 40. This hole allows for suspending the drafting station from a nail in a wall for use as a viewing station for transparencies, or even as a light.

While the preferred embodiment of the invention has been described, modifications can be made and other embodiments may be devised without departing from the spirit of the invention and the scope of the appended claims.

What is claimed is:

1. A portable drafting station which comprises:

a shallow, quadrangular enclosure comprising a tray having a bottom, two pairs of parallel walls and a removable cover made from a slab of translucent material having a smooth top surface;

a light secured to the bottom inside the enclosure;

a T-square made of transparent material;

means for removably attaching the T-square to an underface section of the slab;

at least one drafting triangle made of said transparent material, said triangle having a void area therethrough; and means for mounting the triangle to a second underside section of the cover;

wherein said means for removably attaching the T-square comprises a bracket mounted along one edge of the undersurface of the slab, said bracket forming a recess shaped and dimensioned to snugly receive a cross-member of the T-square and having a slot shaped and dimensioned to receive a leg thereof.

2. The drafting station of claim 1, wherein said means for mounting the triangle comprises a square bracket having a first leg extending downwardly from the undersurface of the slab, and a second leg orthogonal to the first leg extending parallelly to said undersurface and toward said T-square, wherein the distance between said first leg and T-square is commensurate with the distance between one edge of the triangle and said void area.

3. The drafting station of claim 2, wherein said tray comprises a lock mounted against one of said parallel walls and cooperating with said slab, said lock comprising a bolt placed against a section of said wall and projecting toward the slab;

a pair of flexible prongs extending orthogonally from a side of the bolt through an aperture into said wall, each of said flexible prongs having a nib projecting against the opposite face of said wall beyond the periphery of said slot; and means for biasing the bolt toward the slab.

4. The drafting station of claim 3, wherein said means for biasing comprise a pair of flexible legs extending obliquely from opposite sides of the bolt into contact with the bottom of the tray.

5. The drafting station of claim 3, wherein said means for biasing comprise a coil spring compressed between said prongs and a lower rim section of said slot.

* * * * *